US006612773B2

(12) United States Patent
Gray

(10) Patent No.: US 6,612,773 B2
(45) Date of Patent: Sep. 2, 2003

(54) RUMBLE STRIP CUTTER

(75) Inventor: Carey Gray, Spanaway, WA (US)

(73) Assignee: Apply A Line, Inc., Pacific, WA (US)

( * ) Notice: Subject to any disclaimer, the term of this patent is extended or adjusted under 35 U.S.C. 154(b) by 0 days.

(21) Appl. No.: 09/932,235

(22) Filed: Aug. 17, 2001

(65) Prior Publication Data

US 2003/0035687 A1 Feb. 20, 2003

(51) Int. Cl.[7] ..... G01C 23/16
(52) U.S. Cl. ..... 404/94; 404/93
(58) Field of Search ..... 404/93, 94

(56) References Cited

U.S. PATENT DOCUMENTS

| | | | | | |
|---|---|---|---|---|---|
| 4,701,069 | A | * | 10/1987 | Whitney | 116/63 R |
| 4,797,025 | A | | 1/1989 | Kennedy | |
| 5,297,894 | A | | 3/1994 | Yenick | |
| 5,391,017 | A | | 2/1995 | Thomas | |
| 5,415,495 | A | * | 5/1995 | Johnson | 404/84.05 |
| 5,484,228 | A | | 1/1996 | Thomas | |
| 5,582,490 | A | | 12/1996 | Murray | |
| 5,607,255 | A | | 3/1997 | Thomas | |
| 5,676,490 | A | * | 10/1997 | Nelson | 299/39.4 |
| 5,860,764 | A | * | 1/1999 | Roberts | 404/124 |
| 6,176,551 | B1 | * | 1/2001 | Page | 172/684.5 |
| 6,203,112 | B1 | * | 3/2001 | Cook et al. | 125/13.01 |
| 6,220,783 | B1 | * | 4/2001 | Maxwell | 404/93 |
| 6,402,252 | B1 | * | 6/2002 | Dickson | 299/39.6 |
| 6,454,490 | B1 | * | 9/2002 | Murphy | 404/75 |

* cited by examiner

*Primary Examiner*—Thomas B. Will
*Assistant Examiner*—Raymond W Addie
(74) *Attorney, Agent, or Firm*—David L. Tingey

(57) ABSTRACT

A rumble strip cutter machine having a nonoscillating main frame supported on round, ground-engaging operational support wheels with an oscillating moving frame generally coplanar within the main frame, moving slightly out of the common plane during oscillatory motion effected through crank action driven by an operational support wheel. A grinder brush is mounted central under the moving frame between the frame pivot pin and the crank connection. An engine is mounted over the brush also on the moving frame drives the brush and by its weight forces the brush into pavement below. For nonoperational transport at highway speeds the main frame is lifted off of its operational support wheels by a pair of hydraulically-actuated auxiliary wheels at the main frame rear end. The front operational wheels are lifting off of the ground by rotating and locking a trailer tongue on the main frame front end toward the frame.

15 Claims, 5 Drawing Sheets

RUMBLE STRIP CUTTER

BACKGROUND

1. Field of Technology

This invention relates generally to pavement grinder machines, and more particularly to machines for cutting periodic depressions in road pavement, or rumble strips.

2. Prior Art

It is commonplace to have means on highways that alert drivers that their vehicle has drifted outside of a normal travel lane. One means of doing so is a series of periodic depressions in road pavement alongside a normal travel lane. These periodic depressions are commonly termed "rumble strips" because of the effect on a vehicle running over the depressions.

Machines have been disclosed that cut these rumble strips. Commonly, these machines comprise one or more lobed rolling wheels supporting the machine as it travels along the road causing the machine to move up and down with the lobes. A grinder brush below the machine penetrates into the pavement on lobe lows and lifts above the pavement on lobe highs. Although functional, with the full weight of the machine cycling up and down on its wheels, the machine is difficult manage and the continuous jarring exacerbates maintenance requirements. A machine that rolled normally on round wheels would obviate or reduce many of these requirements. Prior machines based on round rolling wheels have been large and complex and thus also costly and difficult to maintain, making them commercially less effective.

SUMMARY

One object of the present invention is to provide a rumble strip cutting machine that rolls along a road smoothly, all ground engaging elements being round to limit weight shifting within the machine. Another object is to drive a vertically-oscillating grinder brush by measured movement of the machine along the road. Another object is to provide an oscillating frame within a smoothly-traveling, nonoscillating main frame that travels smoothly along the road. It is a further object that the oscillating frame, or moving frame, be driven by a crank action on a crankshaft internal the machine. It is yet another object that the crank action be driven solely by rotation of a round, ground-engaging wheel, preferably a support wheel. It is a further object that the machine be compact, of size comparable to an engine driving the grinder brush, along with attendant peripherals. It is another object that the machine be towable. It is a still another object that the ground-engaging wheels supporting the machine during operation be lifted from the ground during nonoperational transport, supported on a plurality of auxiliary wheels more conducive to highway travel speeds. It is a final object that the machine cut repetitive and periodic pavement depressions of uniform size and spacing.

These objectives are achieved in a rumble strip cutter machine comprising a nonoscillating main frame of generally rectangular configuration supported on round, ground-engaging operational support wheels. For nonoperational transport at highway speeds the main frame is lifted off of its operational support wheels by a pair of hydraulically-actuated auxiliary wheels at the main frame rear end, pivotable on support bars from a stored position during machine operation to a support position in which the rear operational support wheels are lifted off of the ground by the auxiliary wheels. The front operational wheels are lifted off the ground by rotating and locking a trailer tongue on the main frame front end toward the frame. To lower the front operational wheels into engagement with the ground, the trailer tongue is rotated away from the main frame by extending a hydraulic cylinder, urging the trailer tongue away from a front wheel axle while pivoting on a tongue pivot pin on a tongue upper portion at the main frame front.

An oscillating moving frame also of generally rectangular configuration coplanar within the main frame in a rest position moves slightly out of the common plane during its oscillatory motion. The moving frame oscillation is driven by crank and crankshaft action. A crankshaft is rotated solely by a mechanical arrangement of axles and gears driven by a ground-engaging wheel, preferably a front operational support wheel. A rod connects between the crank and the moving frame front end. With the moving frame rear end pivotably connected to the main frame rear end approximately over rear operational support wheels, pivotably lifting and lowering of the moving frame front end compacts an effective length of the machine with maximum moving frame movement at its front end.

A grinder brush is mounted central under the moving frame between the frame pivot pin and the crank lift position allowing an effective compact design while maximizing leverage effect by lifting with the crank at the moving frame front, most distant from the pivot pin, the crank lifting maximum weight with minimum materials strength and corresponding weight and allowing the ground engaging wheel to provide the sole drive for lifting the inner frame without need of auxiliary lifting mechanisms. An engine power plant is mechanically connected to the grinder brush through an arrangement of pulley belts or chains. The weight of the engine, mounted on the inner frame directly over the grinder brush, urges the grinder brush into the pavement. With the engine also mounted central the inner frame, the lifting effect of the crank is also maximized, as described above.

DETAILED DESCRIPTION

Figure 1:
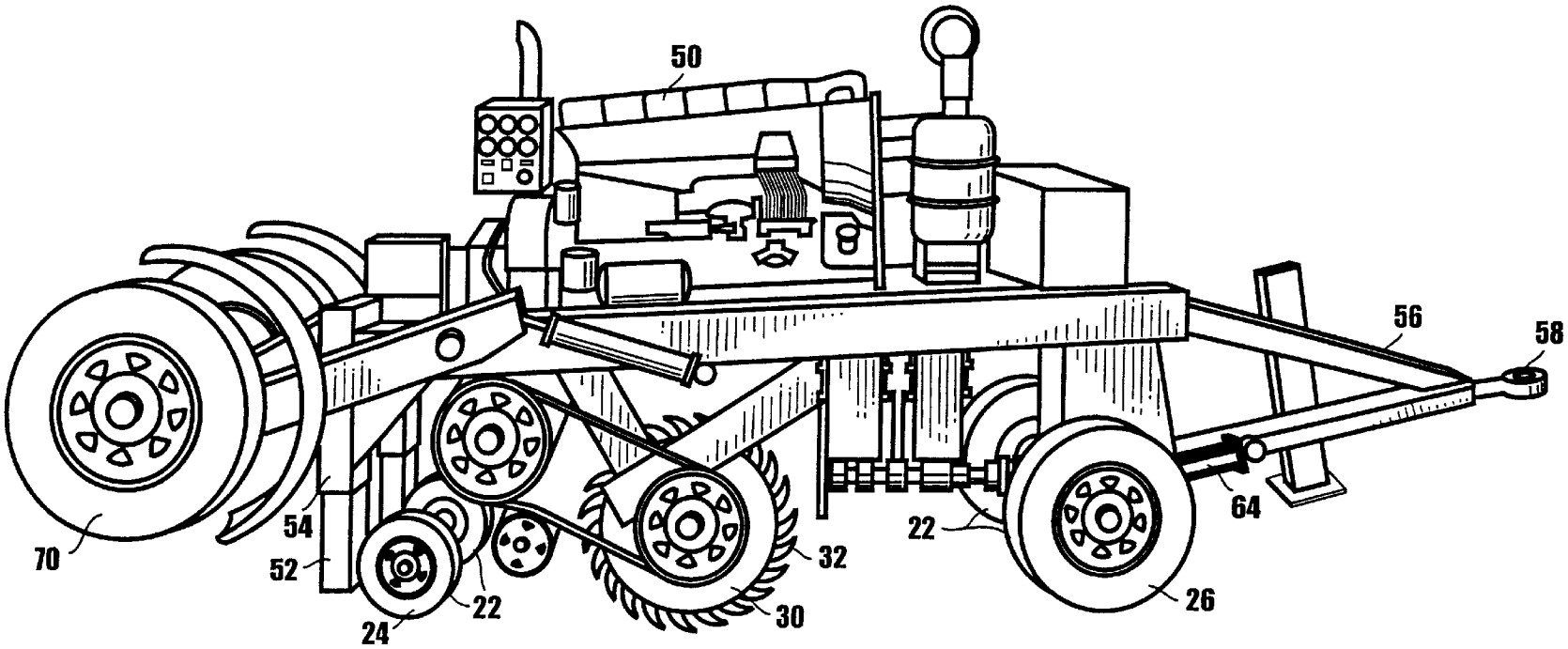
FIG. 1 is a perspective side view the rumble strip cutter of the present invention
Figure 2:
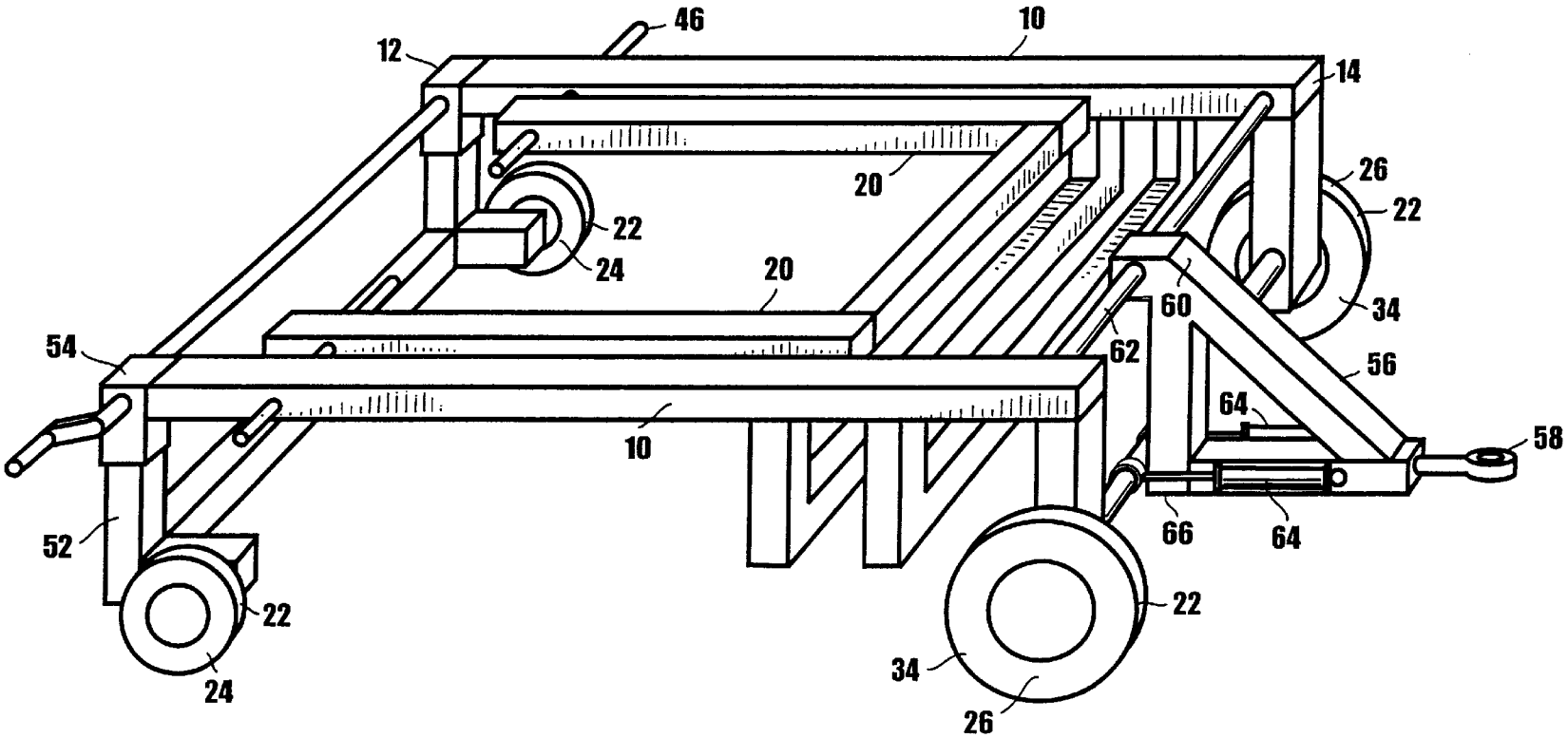
FIG. 2 is a perspective view showing coplanar inner and outer frames supported on ground-engaging operational support wheels together with length-adjustable rear stanchions on which the rear wheels are attached to establish a desired penetration of the grinder brush into pavement below, also showing the trailer tongue pivotably mounted on the main frame front and pivotable away from a front operational wheel axle to lower the front wheels with hydraulic cylinder extended and lift them with hydraulic cylinder retracted, shown extended in the figure.
Figure 3:
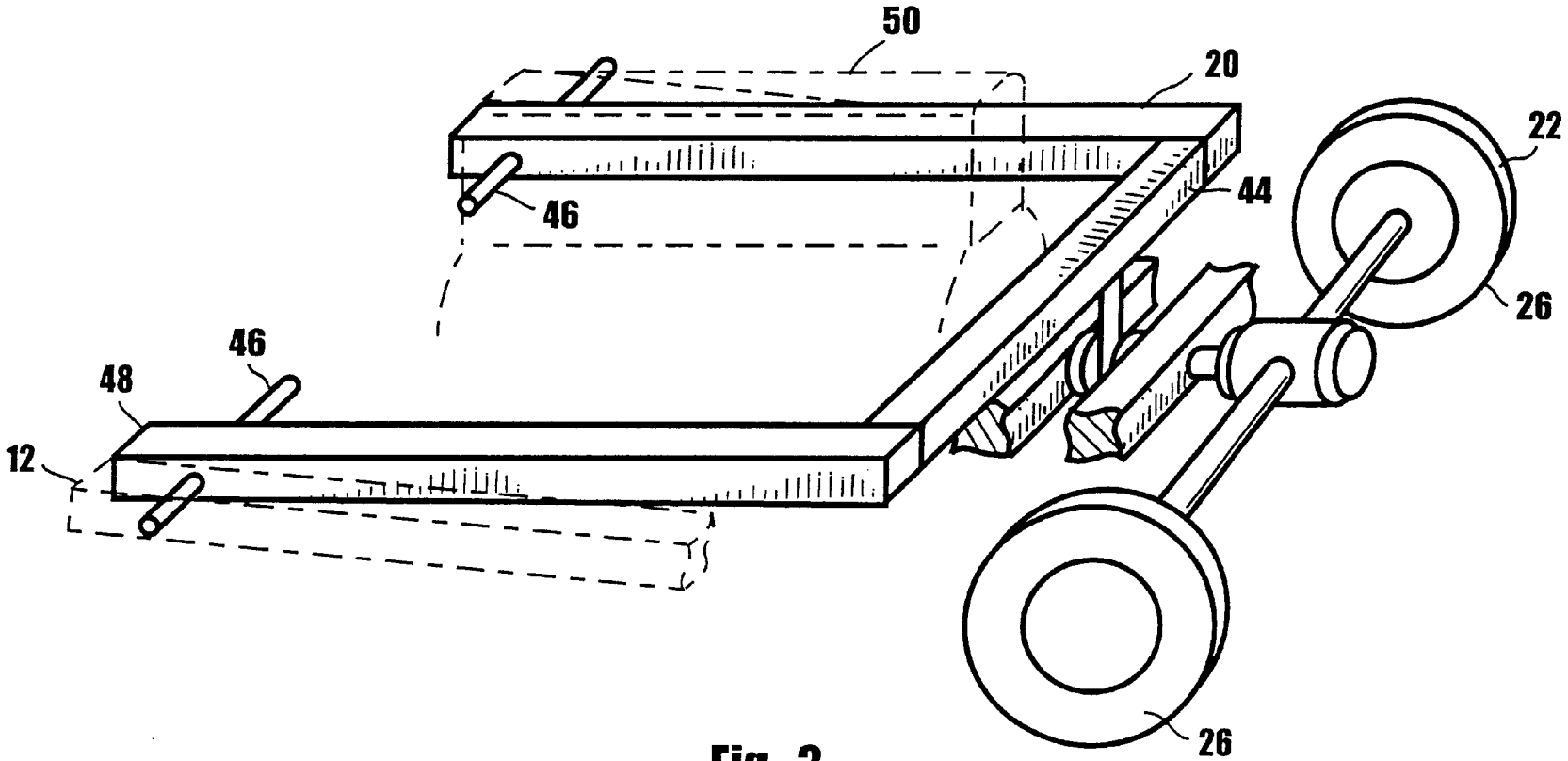
FIG. 3 shows the moving cylinder displaced from coplanar position with the main frame as it is lifted by a crank driven by front operational support wheels.
Figure 4:
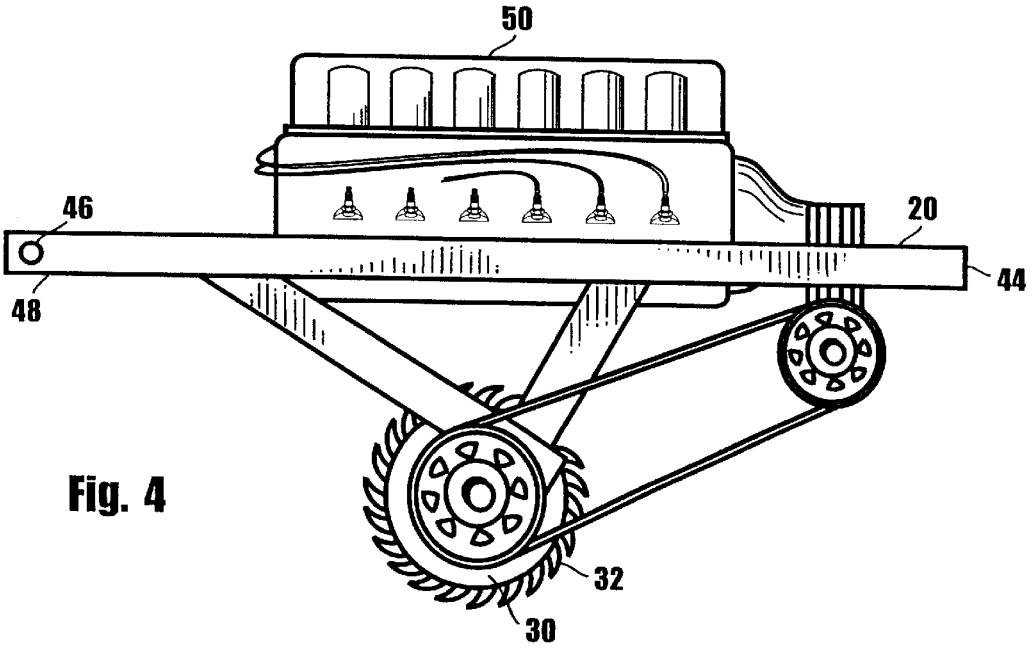
FIG. 4 is a side view showing the engine mounted on the moving frame over the grinder brush central the moving frame, linked by an arrangement of belts and pulleys.
Figure 6:
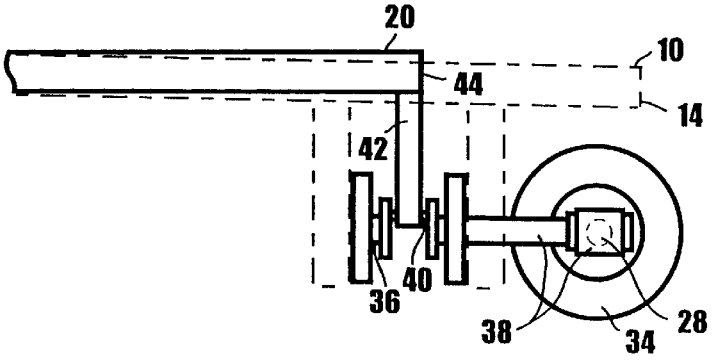
FIG. 6 shows the crankshaft connected between the drive wheels and the inner frame front end.
Figure 5:
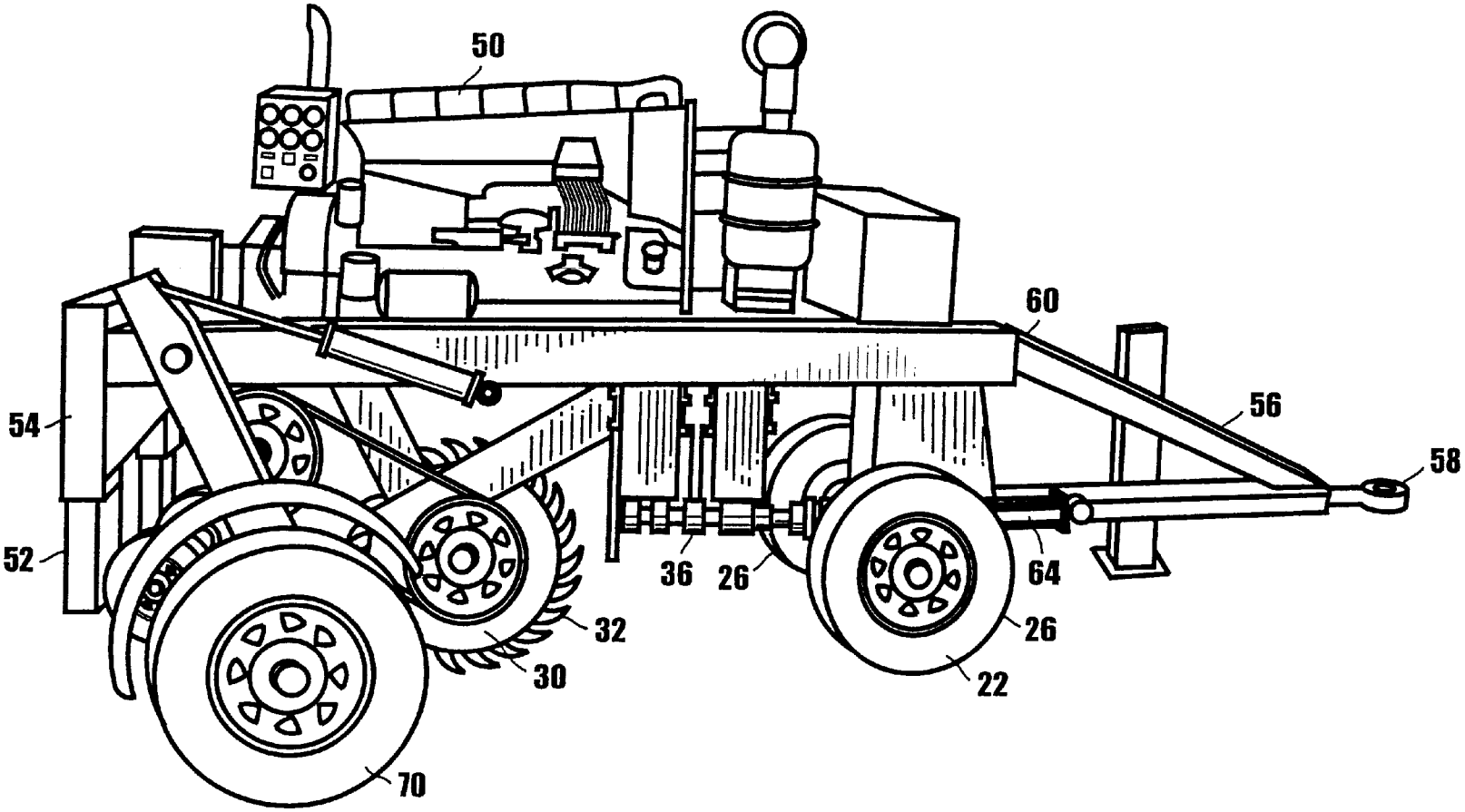
FIG. 5 is the machine FIG. 1 with the hydraulic cylinder extended to lower the front support wheels into operational position, also showing rear auxiliary wheels lowered to lift rear operational support wheels from the ground in preparation of nonoperational transport of the machine and highway speeds.

The rumble strip cutting machine of the present invention for cutting rumble strips in pavement as the machine moves down a road includes a main frame 10 and a moving frame 20 pivotably connected to the main frame 10, typically at its rear end. The moving frame 20, typically rectangular, is generally coplanar within the main frame, also typically rectangular, with small movements out of and returning to the common plane as the moving frame pivotably cycles up and down at one end, typically its front end, and remains nonoscillating in pivotal connection at its other end.

A plurality of ground-engaging wheels 22 comprise a pair of ground-engaging operational rear wheels 24 disposed to rotate on an axis (not shown) at the main frame rear end 12 and a pair of front wheels 26 disposed to rotate on a front axle 28 at the main frame front end 14. All ground-engaging wheels 24 are round typical of rolling vehicles as opposed to a cammed wheel that might cause the frame to lift and lower but would also impede normal smooth frame movement along a road A cylindrical grinder brush 30 is mounted on the moving frame 20 transverse to machine travel and disposed to contact the pavement as the moving frame 20 is lowered. A plurality of grinder elements 32 project generally radially along its circumference. The grinder elements engage pavement below as the brush rotates on a cylinder axis transverse to vehicle travel.

A drive wheel 34, typically a front wheel, drives a crankshaft 36 through a series of axles and gears 38. The crankshaft with a normal attendant crank 40 is mounted to the main frame 10. Thus, when the drive wheel 34 rotates as it engages the ground, it causes the crankshaft 36 to rotate with its crank 40 rising and falling as it rotates around the crankshaft. The crank 40 is connected by a rod 42 to the moving frame 20 at the moving frame front end 44 while the moving frame 20 pivots on a frame pivot pin 46 on the main frame 10 at the moving frame rear end 48. Thus, rotation of the crankshaft 36 causes the crankshaft crank 40 to pivotably lift and lower the moving frame front end 44.

An engine 50 is mounted over the grinder brush on the moving frame 20 and mechanically connected to the grinder brush 30 such that the engine 50 causes the grinder brush 30 to rotate. The weight of the engine 50 on the moving frame 20 to which the grinder brush 30 is also mounted drives the grinder brush 30 into the pavement when the crank 40 lowers the moving frame 20. When the crank 40 raises the moving frame 20, the grinder brush 30 is lifted above the pavement to interrupt pavement grinding.

To provide for vertical adjustment of the rear wheels 24, and hence the depth of penetration of the grinder brush 30, each of the rear wheels 24 is mounted to a stanchion 52 that telescopes from a tube 54 at the main frame rear end 12. The stanchion 52 is secured at a selected position in the tube to achieve the desired adjustment.

Typically, the machine is pulled by a truck or tractor. Thus, a trailer tongue 56 with an attendant hitch 58 is connected to the main frame front end 14. To provide for raising and lowering of the front wheels 26, the trailer tongue 56 is mounted pivotable with an upper tongue portion 60 pivotably mounted on a tongue pivot pin 62 to the main frame 10. A pair of hydraulic cylinders 64 extend between the front axle 28 secured to the main frame 10 on which the front wheels 26 are rotatably mounted and a lower portion 66 of the trailer tongue 56. Thus, when the hydraulic cylinders 64 are extended, the tongue 56 is separated from the front axle 28, tilting the tongue upward and the wheels lower to an operational position. Likewise, when the hydraulic cylinders 64 are retracted, the tongue is drawn to the front axle 28, shortening the distance between the hitch 58 and the front axle 28 on the main frame 10, lifting the wheels off of the ground as the main frame is supported at the tongue hitch in a traveling position.

A pair of traveling auxiliary wheels 70 is pivotably connected to the main frame rear end 12 to support the frame rear end as the frame front end 14 is supported at the trailer hitch 58, thus, lifting both the front and rear wheels that engage the ground during operation and readying the machine for general, nonoperational travel. The auxiliary wheels 70 are each mounted on a mounting bar that moves between a rear traveling position in which the auxiliary wheels 70 are lowered to the ground and a rear operational position in which the wheels are raised such that the rear ground-engaging wheels support the main frame.

Having described the invention, what is claimed is:

1. A machine for cutting rumble strips in pavement, comprising a main frame with a front end and a rear end, a moving frame pivotably connected to the main frame on a frame pivot pin extending between the moving frame and the main frame at a moving frame rear end, an engine mounted on the moving frame, rear wheels and front wheels disposed to engage pavement or ground beneath the machine, the rear and front wheels rotatably attached to the main frame at the main frame rear end and the main frame front end respectively, and further comprising a drive wheel, all wheels being round typical of rolling vehicles, a crank on a crankshaft mounted to the main frame, the crankshaft mechanically connected to the drive wheel such that when the drive wheel rotates as it engages the ground it causes the crankshaft to rotate with its crank rising and falling as it rotates around the crankshaft, said crank mechanically linked to the moving frame spaced apart from the pivot pin such that rotation of the crankshaft causes the crank to lift and lower the moving frame front end in oscillatory motion as the moving frame rear end remains nonoscillating in pivotal attachment to the main frame, a grinder brush mounted on the moving frame transverse to machine travel and disposed to contact the pavement as the moving frame is lowered, the grinder brush mechanically connected to the engine such that the engine causes the grinder brush to rotate, the weight of the engine driving the grinder brush into the pavement when the crank lowers the moving frame.

2. The machine of claim 1 in which the engine and grinder brush are mounted central the moving frame between the pivot pin and the crankshaft with the engine over the grinder brush, the moving frame supported between the frame pivot pin at its rear end and by the crankshaft crank at the crank support position at its front end.

3. The machine of claim 1 further wherein said rear wheels support the main frame rear end on length-adjustable rear wheel supports adapted to vertically adjust the rear wheels relative to the main frame to achieve a measured penetration of the grinder brush into the pavement.

4. The machine of claim 3 wherein said length-adjustable rear wheel supports comprise-stanchions telescoping from rear frame-supporting tubes secured at a selected position.

5. The machine of claim 1 further comprising a trailer tongue pivotably connected to the main frame front end, a front axle on which the front wheels are rotatably mounted, said front wheels connected to the main frame front end and the trailer tongue, the front wheels and the trailer tongue pivoting between a front operational position and a front traveling position wherein the main frame is supported at its front in the front operational position by the front wheels and in the traveling position by the tongue with the front wheels lifted from the ground.

6. The machine of claim 5 wherein the drive wheel is disposed to engage the ground only when the main frame is in the front operational position.

7. The machine of claim 6 wherein the drive wheel comprises a front wheel.

8. The machine of claim 5 further comprising, in the trailer tongue, an upper portion and a lower portion, the upper portion connected pivotably to the main frame at the main frame front end and the lower portion adjustably connected to the front axle and a trailer hitch spaced apart from the main frame, and at least one hydraulic cylinder between the lower portion and the front axle adjusting distance between the tongue and the axle such that when the hydraulic cylinder is in a first position the wheels and main frame are lowered together into the front operational position and when the hydraulic cylinder is in a second position the front wheels and the main frame are raised together into the front traveling position, supported at the tongue hitch.

9. The machine of claim 1 further comprising a pair of auxiliary wheels pivotably connected to the main frame rear end and moving between a rear traveling position in which the auxiliary wheels are lowered to the ground and a rear operational position in which the rear wheels are raised such that the rear wheels support the main frame.

10. The machine of claim 1 in which the grinder brush is cylindrical and includes brush cutting elements along its circumference for engaging pavement as the brush rotates on a cylinder axis transverse to vehicle travel.

11. A machine for cutting rumble strips in pavement, comprising a main frame with a front end and a rear end, a frame pivot pin at the main frame rear end, a moving frame within the main frame and pivotably connected to the main frame on the frame pivot pin at a moving frame rear end, an engine mounted on the moving frame, rear wheels and front wheels disposed to engage pavement or ground beneath the machine, the rear and front wheels rotatably attached to the main frame at a the main frame rear end and the main frame front end respectively, and further comprising a drive wheel, a crank on a crankshaft between the drive wheel and the moving frame lifting and lowering the moving frame pivotably within the main frame as the drive wheel rotates, a grinder brush mounted on the moving frame and transverse to machine travel and disposed to contact the pavement as the moving frame is lowered, the grinder brush mechanically connected to the engine such that the engine causes the grinder brush to rotate, the weight of the engine driving the grinder brush into the pavement when the crank lowers the moving frame.

12. The machine of claim 11 in which the main frame and the moving frame are generally coplanar with the moving frame inside of the main frame.

13. The machine of claim 11 in which the moving frame is lifted and lowered pivotably in oscillating motion solely by action of the crankshaft.

14. The machine of claim 11 in which the frame pivot pin is located approximately over the rear wheels.

15. A machine for cutting rumble strips in pavement, comprising a main frame with a front end and a rear end, a moving frame pivotably connected to the main frame on a frame pivot pin extending between the moving frame and the main frame at the moving frame rear end, an engine mounted on the moving frame, a pair of rear wheels and a pair of front wheels disposed to engage pavement or ground beneath the machine, the rear and front wheels rotatably attached to the main frame at the main frame rear end and the main frame front end respectively, and further comprising a drive wheel, a crank on a crankshaft mounted to the main frame, the crankshaft mechanically connected to the drive wheel such that when the drive wheel rotates as it engages the ground it causes the crankshaft to rotate with its crank rising and falling as it rotates around the crankshaft, said crank mechanically linked to the moving frame spaced apart from the pivot pin such that rotation of the crankshaft causes the crank to lift and lower the moving frame front end in oscillatory motion, a grinder brush mounted on the moving frame transverse to machine travel and disposed to contact the pavement as the moving frame is lowered, the grinder brush mechanically connected to the engine such that the engine causes the grinder brush to rotate, the weight of the engine driving the grinder brush into the pavement when the crank lowers the moving frame, the engine and grinder brush mounted central the moving frame between the pivot pin and the crankshaft under the engine such that the weight of the engine is over the grinder brush, the moving frame supported between the frame pivot pin at its rear end and by the crankshaft crank at the crank support position at its front end, stanchions telescoping from rear frame-supporting tubes secured at a selected position, a trailer tongue pivotably connected to the main frame front end, a front axle on which the front wheels are rotatably mounted, said front wheels connected to the main frame front end and the trailer tongue, the front wheels and the trailer tongue pivoting between a front operational position and a front traveling position wherein the main frame is supported at its front in the front operational position by the front wheels and in the traveling position by the tongue with the front wheels lifted from the ground, wherein the drive wheel is disposed to engage the ground only when the main frame is in the front operational position and wherein the drive wheel comprises a front wheel, in the trailer tongue, an upper portion and a lower portion, the upper portion connected pivotably to the main frame at the main frame front end and the lower portion adjustably connected to the front axle and a trailer hitch spaced apart from the main frame, and at least one hydraulic cylinder between the lower portion and the front axle adjusting distance between the tongue and the axle such that when the hydraulic cylinder is in a first position the wheels and main frame are lowered together into the front operational position and when the hydraulic cylinder is in a second position the front wheels and main frame are raised together into the front traveling position, supported at the tongue hitch, a pair of auxiliary wheels pivotably connected to the main frame rear end and moving between a rear traveling position in which the auxiliary wheels are lowered to the ground and a rear operational position in which the rear wheels are raised such that the rear wheels support the main frame.

* * * * *